US007058186B2

(12) United States Patent
Tanaka

(10) Patent No.: US 7,058,186 B2
(45) Date of Patent: Jun. 6, 2006

(54) LOUDSPEAKER DEVICE

(75) Inventor: Hidekazu Tanaka, Mie (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 272 days.

(21) Appl. No.: 10/148,011

(22) PCT Filed: Nov. 29, 2000

(86) PCT No.: PCT/JP00/08411

§ 371 (c)(1),
(2), (4) Date: Sep. 4, 2002

(87) PCT Pub. No.: WO01/41500

PCT Pub. Date: Jun. 7, 2001

(65) Prior Publication Data

US 2003/0108213 A1 Jun. 12, 2003

(30) Foreign Application Priority Data

Dec. 1, 1999 (JP) ..... 11-341750

(51) Int. Cl.
*H04R 3/00* (2006.01)
*H04R 29/00* (2006.01)

(52) U.S. Cl. ..... 381/95; 381/96; 381/58; 381/59

(58) Field of Classification Search ..... 381/83, 381/93, 96, 58–59, 103, 95, 91, 61
See application file for complete search history.

(56) References Cited

U.S. PATENT DOCUMENTS

| | | | | |
|---|---|---|---|---|
| 4,592,088 | A * | 5/1986 | Shimada | 381/96 |
| 5,588,065 | A * | 12/1996 | Tanaka et al. | 381/96 |
| 6,088,459 | A | 7/2000 | Hobelsberger | 381/96 |
| 6,353,670 | B1 * | 3/2002 | Gasner | 381/96 |

FOREIGN PATENT DOCUMENTS

| | | |
|---|---|---|
| EP | 0 658 064 | 6/1995 |
| JP | 10-32895 | 2/1998 |
| JP | 10032895 A * | 2/1998 |

OTHER PUBLICATIONS

Merriam-Webster's Collegiate Dictionary, 1997, Merriam-Webster, Incorporated, Tenth Edition, p. 137.*
International Search Report corresponding to application No. PCT/JP00/08411 dated May 10, 2001.
International Preliminary Examination Report corresponding to PCT/JP00/08411 dated Jan. 21, 2002.

* cited by examiner

*Primary Examiner*—Laura A. Grier
(74) *Attorney, Agent, or Firm*—RatnerPrestia

(57) ABSTRACT

An anti-oscillation loudspeaker device where a reproduced sound is compensated based on a acoustic signal detected by a microphone and a reproduced band is enlarged is provided. In this loudspeaker device, a microphone is placed near a position where sound pressure of resonance occurring in a closed space for at least one of height, width, and depth of the inside of a cabinet is minimum. An influence of the resonance is restrained, a feedback circuit becomes stable, and a feedback amount increases.

12 Claims, 6 Drawing Sheets

LOUDSPEAKER DEVICE

This application is a U.S. National Phase Application of PCT International Application PCT/JP00/008411.

TECHNICAL FIELD

The present invention relates to a loudspeaker device used for various video/audio apparatuses, and more particularly to a loudspeaker device that detects a reproduced sound supplied from a loudspeaker unit and compensates the reproduced sound.

PRIOR ART

The prior art is described with reference to FIG. 5A, FIG. 5B, and FIG. 6.

FIG. 5A is a side sectional view of a conventional loudspeaker device, FIG. 5B is an upside sectional view of it, and FIG. 6 shows a frequency characteristic of a microphone incorporated into the loudspeaker device.

Loudspeaker unit 1 is mounted to an opening of cabinet 2, and an acoustic output signal is emitted. In cabinet 2, microphone 3 for detecting the acoustic output signal generated from the rear part of loudspeaker unit 1 is disposed in an easy-to-install place close to loudspeaker unit 1. Using the detected acoustic output signal, a low frequency band is compensated with feedback and is enlarged.

The acoustic output signal detected by microphone 3 depends on height H, width W, and depth D of the inside of cabinet 2, and has a sound-pressure frequency characteristic having sharp peaks and dips due to a standing-wave generated inside. For enlarging the low frequency band of a sound from loudspeaker unit 1, the feedback is utilized based on the acoustic output signal obtained by eliminating the standing-wave with a filter.

As shown in FIG. 6, in the conventional loudspeaker device, microphone 3 detects an additional acoustic output as resonance occurring in a closed space in cabinet 2, and therefore it is difficult to prevent the device from oscillating. Even if resonance components are tried to remove using the filter, all of them cannot be removed when the resonance is large, and the oscillation cannot be restrained satisfactorily. As a result, enlargement of a reproduced low frequency band is limited in the conventional loudspeaker device.

DISCLOSURE OF THE INVENTION

A loudspeaker device comprises: an amplifier for receiving an input signal; a loudspeaker unit for reproducing an output signal supplied from this amplifier; a cabinet incorporated with this loudspeaker unit; a microphone for detecting an acoustic output supplied from the loudspeaker unit; and a feedback circuit for feeding back an acoustic output signal detected by the microphone to the input of the amplifier. The loudspeaker unit is mounted to an opening in the cabinet to close the cabinet, and the microphone is placed near the position where sound pressure of resonance occurring in a closed space for at least one of height, width, and depth of the inside of the cabinet is minimum. Therefore, an influence of the resonance can be restrained, stability of the feedback circuit is improved, and a feedback amount can increase. The device can thus enlarge the reproduced low frequency band and have a stability thanks to ensure an oscillation margin.

DETAILED DESCRIPTION OF THE PREFERRED EMBODIMENT

Loudspeaker devices in accordance with embodiments of the present invention will be described hereinafter with reference to FIG. 1A through FIG. 4B. In the description, the same elements used in the prior art are denoted with the same reference numbers.

Embodiment 1

Figure 1A:
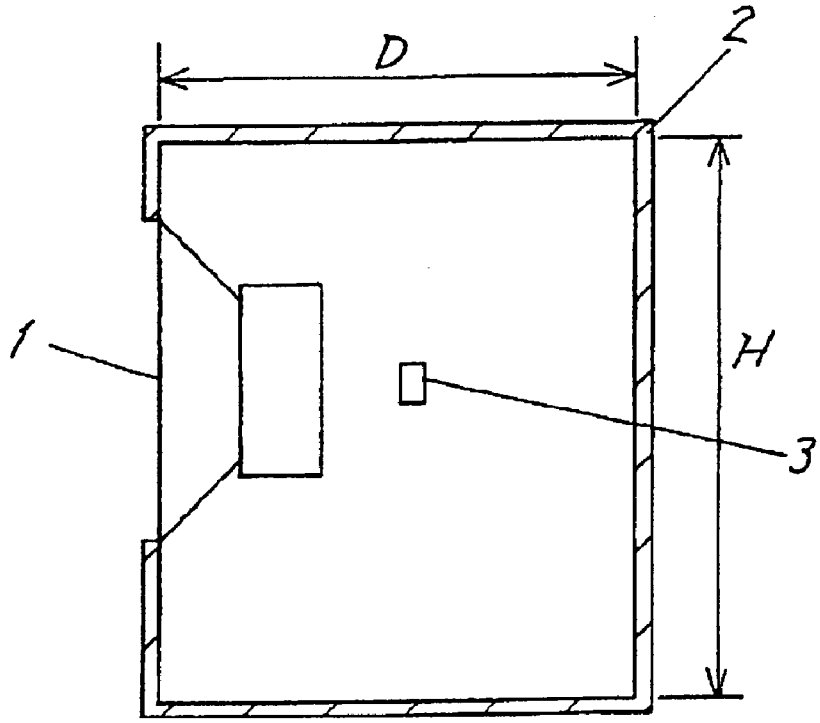
FIG. 1A is a side sectional view of a loudspeaker device in accordance with exemplary embodiment 1 of the present invention.
Figure 1B:
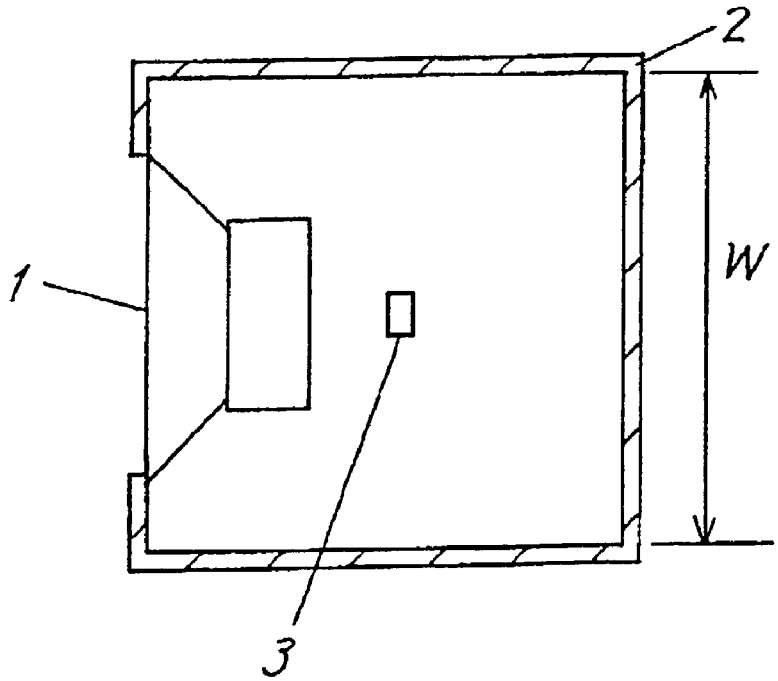
FIG. 1B is an upside sectional view of the loudspeaker device in accordance with exemplary embodiment 1 of the present invention.
Figure 2:
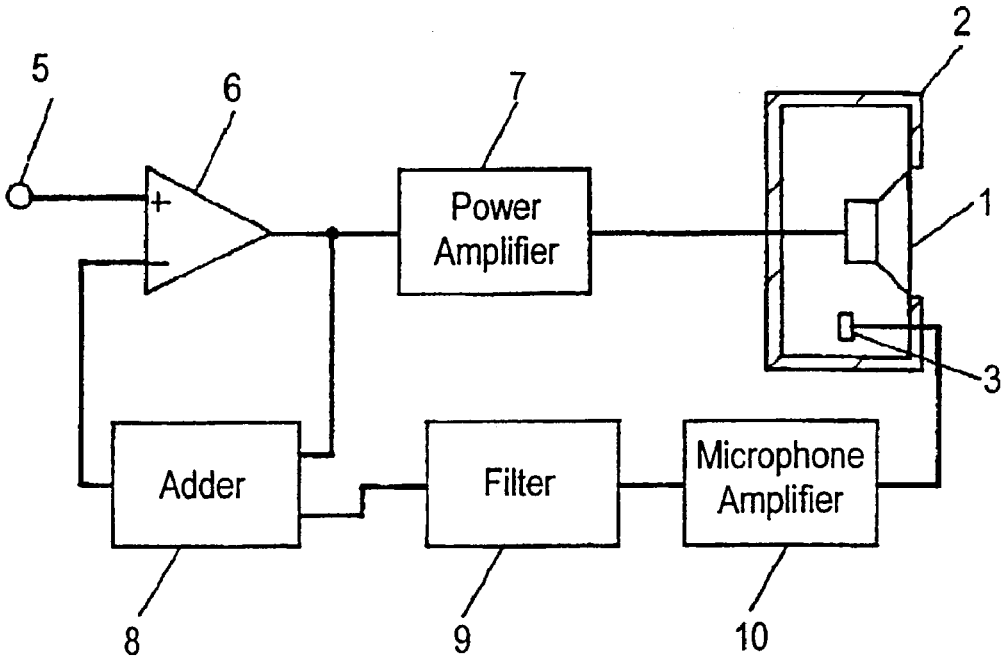
FIG. 2 is a circuit block diagram of the loudspeaker device in accordance with exemplary embodiment 1 of the present invention.
Figure 3:
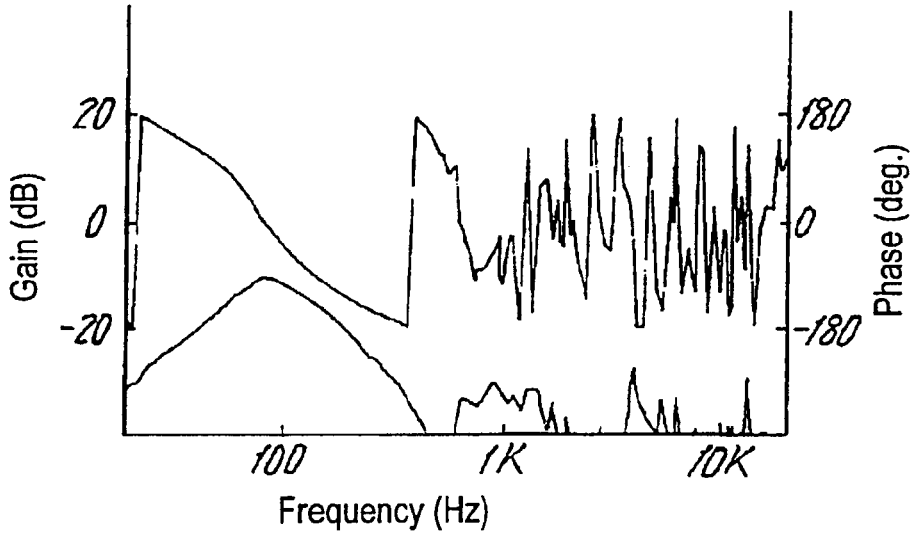
FIG. 3 shows an acoustic output characteristic detected by a microphone in the loudspeaker device in accordance with exemplary embodiment 1 of the present invention.

FIG. 1A is a side sectional view of a loudspeaker device in accordance with embodiment 1 of the present invention, FIG. 1B is an upside sectional view of the loudspeaker device, FIG. 2 is a circuit block diagram of the loudspeaker device, and FIG. 3 shows an acoustic output characteristic of a microphone installed into the loudspeaker device. Loudspeaker unit 1 is mounted to an opening in cabinet 2 having a closed shape and substantially rectangular-parallelepiped shape. Microphone 3 is placed in cabinet 2 through a bracket (not drawn).

As shown in FIG. 2, the loudspeaker device comprises: input terminal 5; differential amplifier 6; power amplifier 7 receiving an output of differential amplifier 6; microphone amplifier 10 receiving an output of microphone 3 for capturing a sound wave supplied from loudspeaker unit 1; filter 9 for eliminating a standing-wave; and adder for adding the output of differential amplifier 6 to an output of filter 9 and for output it to differential amplifier 6. These circuits and loudspeaker unit 1 form a feedback circuit.

A position of microphone 3 will be described in more detail.

Cabinet 2 has resonance frequencies ($f_W$, $f_D$, $f_H$) calculated using the following equations with reference to a closed space having width W, depth D, and height H of cabinet 2.

$$f_W=(n+1)C/2W$$

$$f_D=(n+1)C/2D$$

$$f_H=(n+1)C/2H$$

where n is an integer not less than 1, and C is a sound velocity.

Microphone 3 is attached near positions where sound pressures of respective resonance frequencies are minimum in the closed space.

A relation between an output and an input in the block diagram in FIG. 2 is represented by $$V_{out}/V_{in}=A/(1+A\cdot T(S)),$$

where $V_{out}$ is an output voltage, $V_{in}$ is an input voltage, A is a total gain of the feedback loop, and T(S) is a transfer function.

When microphone 3 has an almost flat frequency characteristic, transfer function T(S) is substantially that of loudspeaker unit 1. Depending on a phase of the resonance in the closed space formed by loudspeaker unit 1 and cabinet 2, value of transfer function T(S) may be −1. When the value is −1, the device oscillates. Because microphone 3 does not detect the resonance occurring in the closed space in cabinet 2 in the embodiment of the present invention, the value of transfer function T(S) is extremely hardly −1. Therefore, the feedback loop is stable, and simultaneously a reproduced low frequency band is enlarged.

FIG. 3 shows an acoustic output characteristic detected by microphone 3. Microphone 3 detects only an acoustic output resonance component on the rear surface of loudspeaker unit 1.

Positions where the sound pressures of the respective resonance frequencies for the width, the depth, and the height are minimum do not necessarily match with each other in cabinet 2 having a rectangular-parallelepiped shape. In the present embodiment, microphone 3 is placed near the minimum-sound-pressure positions where transfer function T(S) is not −1. Also when microphone 3 is placed near the positions where the sound pressures of the resonance frequencies for one or two of the width, the depth, and the height are minimum, a loudspeaker device where a position of microphone 3 is extremely easily set is provided though the loudspeaker device has somewhat lower stability comparing with the arrangement discussed above.

In embodiment 1, the closed space has a rectangular-parallelepiped shape. However, even when the cabinet has a shape other than the shape, for example a sphere, a similar effect is obtainable. Even when the microphone is placed near positions where sound pressures of resonance frequencies in the entire closed space or a part of the closed space in the cabinet are minimum, a similar effect is obtainable.

Embodiment 2

Figure 4A:
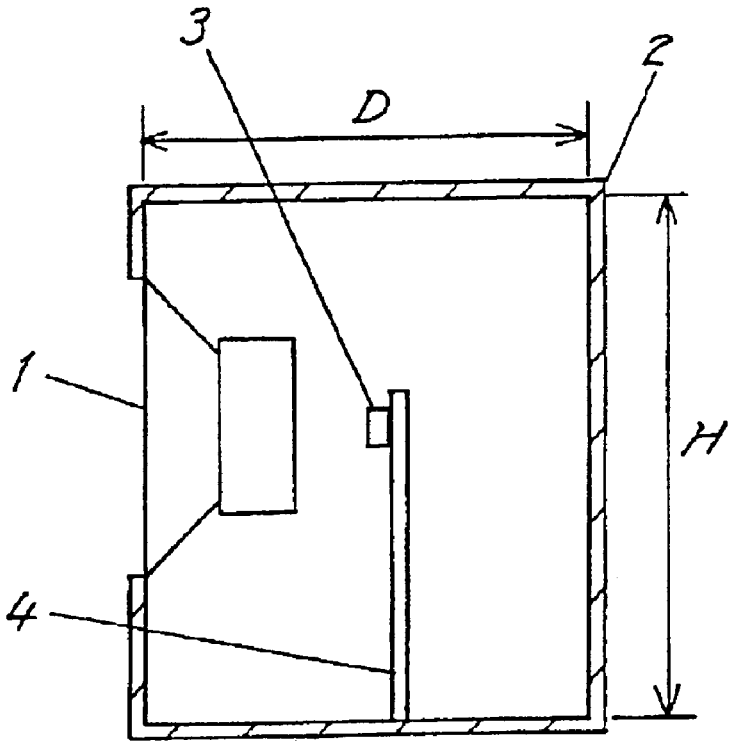
FIG. 4A is a side sectional view of a loudspeaker device in accordance with exemplary embodiment 2 of the present invention.
Figure 4B:
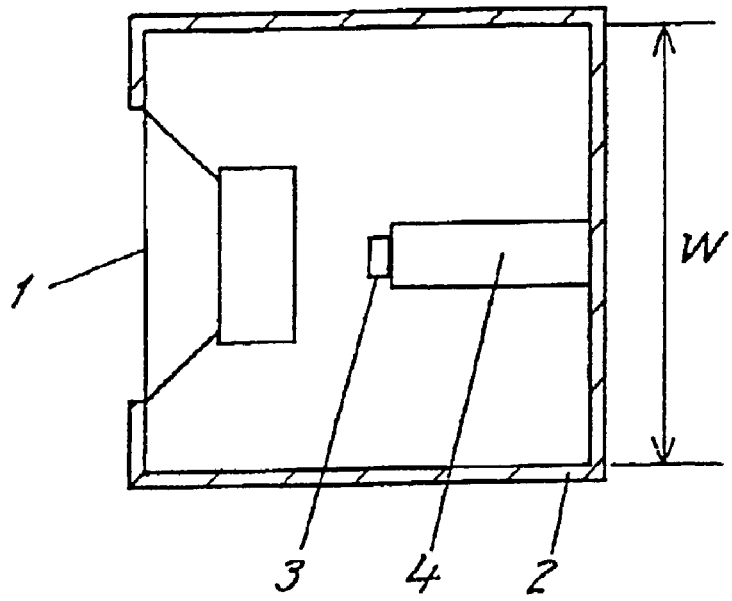
FIG. 4B is an upside sectional view of the loudspeaker device in accordance with exemplary embodiment 2 of the present invention.
Figure 5A:
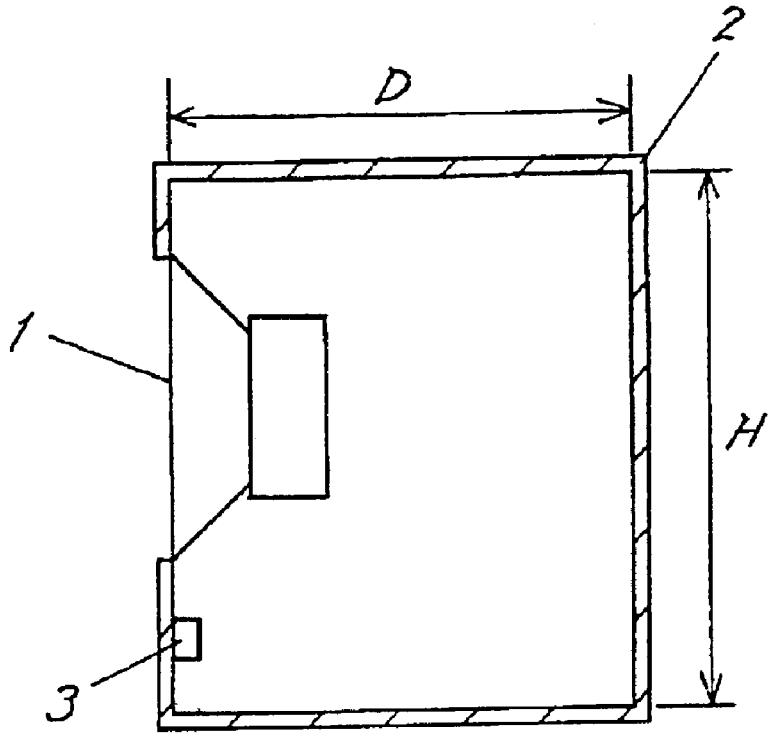
FIG. 5A is a side sectional view of a conventional loudspeaker device.
Figure 5B:
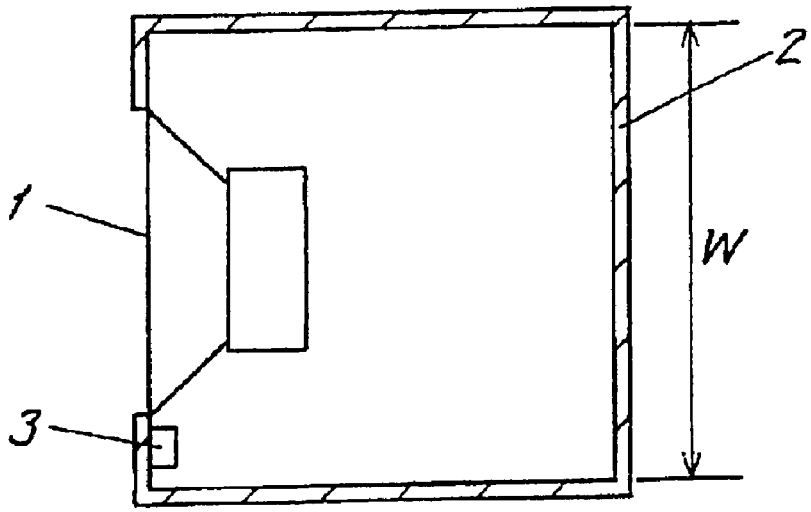
FIG. 5B is an upside sectional view of the conventional loudspeaker device
Figure 6:
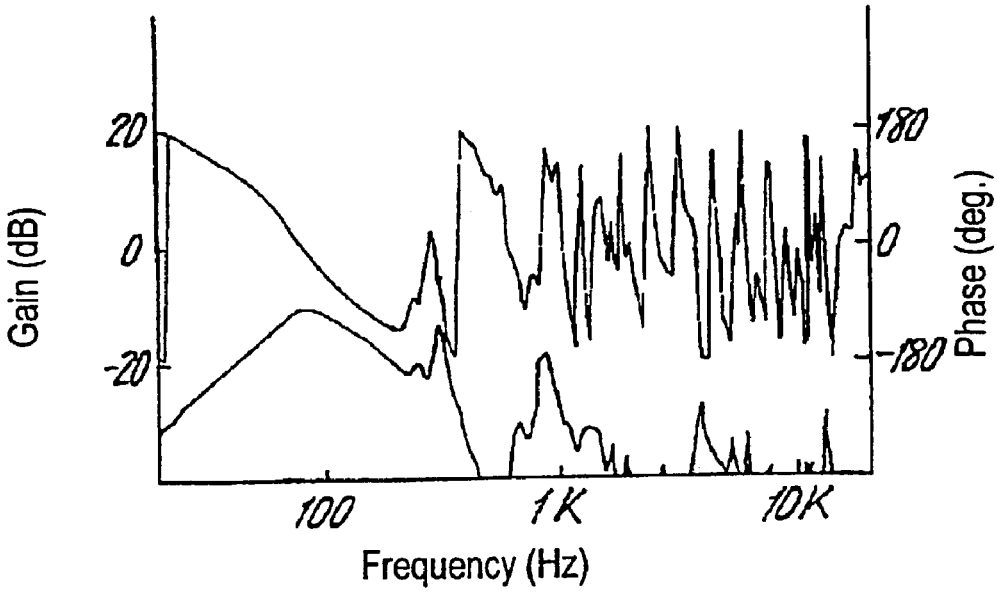
FIG. 6 shows an acoustic output characteristic detected by a microphone in the conventional loudspeaker device.

FIG. 4A is a side sectional view of a loudspeaker device in accordance with embodiment 2 of the present invention, and FIG. 4B is an upside sectional view of the loudspeaker device.

Only a difference from embodiment 1 will be described. The difference is that microphone 3 is mounted to cabinet 2 with bracket 4.

If bracket 4 is designed appropriately, microphone 3 can be mounted to any position without constraints in cabinet 2. In addition, cabinet 2 is not required to have a complex structure for mounting microphone 3, and therefore, a resin-molding die of cabinet 2 is efficiently designed.

Bracket 4 is mounted in a method such as an integral molding during forming of cabinet 2, molding with the same material especially when strength is not lowered, screw fastening, adhesion, and fixing to a printed board constituting a feedback circuit.

In embodiments 1 and 2, a disposition and an operation of all elements like the loudspeaker unit, the microphone, the feedback circuit, and the amplifier are explained. Electronic circuits, which are elements except the loudspeaker unit or the microphone, can be disposed rather freely. The technique in the invention covers the loudspeaker devices where the cabinet houses just the loudspeaker unit and the microphone and where the cabinet houses them and a part of the electronic circuit.

INDUSTRIAL APPLICABILITY

The present invention relates to a loudspeaker device used for various video/audio apparatuses, and more particularly to a loudspeaker device that detects a reproduced sound from a loudspeaker unit and compensates the reproduced sound. A loudspeaker device that hardly oscillates and has an enlarged reproduced low frequency band is provided, while improving stability of a feedback circuit and increasing a feedback amount.

REFERENCE NUMERALS

1 Speaker Unit
2 Cabinet
3 Microphone
4 Bracket
5 Input Terminal
6 Differential Amplifier
7 Power Amplifier
8 Adder
9 Filter
10 Microphone Amplifier

What is claimed is:

1. A loudspeaker device comprising:
an amplifier for amplifying an input signal;
a cabinet having an opening;
a loudspeaker unit mounted to the opening so as to close said cabinet for reproducing an output signal of said amplifier;
a microphone placed in said cabinet for detecting an acoustic output of said loudspeaker unit; and
a feedback circuit for feeding back an acoustic output signal of said microphone to an input of said amplifier,
wherein said microphone is placed substantially at a position where sound pressure of resonance occurring in a closed space in said cabinet is a minimum for said closed space.

2. The loudspeaker device according to claim 1 further comprising a bracket for placing and mounting said microphone in said cabinet.

3. A loudspeaker device comprising:
an amplifier for amplifying an input signal;
a cabinet having an opening;
a loudspeaker unit mounted to the opening so as to close said cabinet for reproducing an output signal of said amplifier;
a microphone placed in said cabinet for detecting an acoustic output of said loudspeaker unit; and
a feedback circuit for feeding back an acoustic output signal of said microphone to an input of said amplifier,
wherein said microphone is placed substantially at a position where sound pressure of resonance occurring in a closed space for one of height, width, and depth of an inside of said cabinet is a minimum for said closed space.

4. The loudspeaker device according to claim 3 further comprising a bracket for placing and mounting said microphone in said cabinet.

5. A loudspeaker device comprising:

an amplifier for amplifying an input signal;

a cabinet having an opening;

a loudspeaker unit mounted to the opening so as to close said cabinet for reproducing an output signal of said amplifier;

a microphone placed in said cabinet for detecting an acoustic output of said loudspeaker unit; and a feedback circuit for feeding back an acoustic output signal of said microphone to an input of said amplifier, wherein said microphone is placed substantially at a common position where respective resonance occurring in a closed space for at least two of height, width, and depth of an inside of said cabinet is a minimum for said closed space.

6. The loudspeaker device according to claim 5 further comprising a bracket for placing and mounting said microphone in said cabinet.

7. A loudspeaker device comprising:

a cabinet having an opening;

a loudspeaker unit mounted to the opening so as to close said cabinet; and a microphone placed in said cabinet for detecting an acoustic output of said loudspeaker unit, wherein said microphone is placed substantially at a position where sound pressure of resonance occurring in a closed space in said cabinet is a minimum for said closed space.

8. The loudspeaker device according to claim 7 further comprising a bracket used for placing and mounting said microphone in said cabinet.

9. A loudspeaker device comprising:

a cabinet having an opening;

a loudspeaker unit mounted to the opening so as to close said cabinet and being mounted to the opening so as to close said cabinet; and a microphone placed in said cabinet for detecting an acoustic output of said loudspeaker unit, wherein said microphone is placed substantially at a position where sound pressure of resonance occurring in a closed space for one of height, width, and depth of an inside of said cabinet is a minimum for said closed space.

10. The loudspeaker device according to claim 9 further comprising a bracket for placing and mounting said microphone in said cabinet.

11. A loudspeaker device comprising:

a cabinet having an opening;

a loudspeaker unit mounted to the opening so as to close said cabinet and being mounted to the opening so as to close said cabinet; and a microphone placed in said cabinet for detecting an acoustic output of said loudspeaker unit, wherein said microphone is placed substantially at a position where sound pressure of resonance occurring in a closed space for at least two of height, width, and depth of an inside of said cabinet is a minimum for said closed space.

12. The loudspeaker device according to claim 11 further comprising a bracket for placing and mounting said microphone in said cabinet.

* * * * *